US005299550A

United States Patent [19]

Inoue

[11] Patent Number: 5,299,550

[45] Date of Patent: Apr. 5, 1994

[54] DETECTING DEVICE AND METHOD OF AN ABNORMALITY IN AN AIR-FUEL RATIO CONTROL SYSTEM

[75] Inventor: Norikazu Inoue, Tokyo, Japan

[73] Assignee: Fuji Jukogyo Kabushiki Kaisha, Tokyo, Japan

[21] Appl. No.: 19,311

[22] Filed: Feb. 18, 1993

[30] Foreign Application Priority Data

Mar. 30, 1992 [JP] Japan ..... 4-074215

[51] Int. Cl.[5] ..... F02M 7/00; F02M 51/00

[52] U.S. Cl. ..... 123/674

[58] Field of Search ..... 123/674, 480, 486, 690, 123/673, 399; 364/431.02, 431.05, 431.01, 431.11, 431.12; 60/274, 276

[56] References Cited

U.S. PATENT DOCUMENTS 5,080,064 1/1992 Buslepp et al. ..... 123/399
5,131,372 7/1992 Nakaniwa ..... 123/673
5,182,907 2/1993 Kuroda et al. ..... 60/276
5,193,339 3/1993 Furuya ..... 60/274
5,243,951 9/1993 Nakaniwa ..... 123/674
5,247,445 9/1993 Miyano et al. ..... 364/431.12

*Primary Examiner*—Raymond A. Nelli
*Attorney, Agent, or Firm*—Beveridge, DeGrandi, Weilacher & Young

[57] ABSTRACT

In an abnormality detecting device and method for an air-fuel ratio control system of an internal combustion engine, first discriminating whether a renewing number NLR of grids in a map of air-fuel ratio learning control is larger than a set value or not. If the number is larger than the set value, the difference between the number and previously renewed learning values is calculated. Then, judging whether the difference is larger than a predetermined value or not. If the difference is larger than the predetermined value, it is judged that an abnormality occurs in an intake air measurement system or a fuel injection system of an air-fuel ratio control system. Accordingly, the abnormality in the systems is distinguished from the deterioration due to normal aging.

4 Claims, 4 Drawing Sheets

DETECTING DEVICE AND METHOD OF AN ABNORMALITY IN AN AIR-FUEL RATIO CONTROL SYSTEM

BACKGROUND OF THE INVENTION

The present invention relates to a device for detecting an abnormality of an intake air measurement system for measuring an amount of induced air into an engine or a fuel injection system for injecting a fuel into a cylinder of the engine in an air-fuel control system mounted on the engine and a method therefor.

In order to promptly correct an irregularity of an intake air sensor and the like of an intake air measurement system or an injector and the like of a fuel injection system at the time of production or a deviation of an air-fuel ratio due to an aging change, it has been known that a learning control is employed for a feedback control with an air-fuel ratio sensor such as, for example, an $O_2$ sensor or the like to always hold a desired air-fuel ratio even if an operating condition is largely varied.

More specifically, in a normal operating state of an engine, a center value of an air-fuel ratio feedback correction coefficient is stored in map of backup RAM of an electronic control system as learning value (a correction coefficient of an open loop) after the air-fuel ratio sensing $O_2$ sensor repeatedly become rich and lean predetermined number of times by a proportional integration control and the air-fuel ratio feedback correction coefficient is calculated. Thereafter, if the operating condition varies, a fuel injection quantity is compensated by the learning value, a center of the air-fuel ratio feedback correction coefficient is controlled to become a standard value, and the air-fuel ratio of the air-fuel ratio control system of the engine is held at a desired air-fuel ratio.

In this case, in the air-fuel control system, a function for self-diagnosing an abnormality is incorporated so as to cope with a case where an abnormality occurs in a fuel injection system such as, for example, wirings of a fuel injection valve (injector) are disconnected or a short-circuited. For example, Japanese Patent Application Laid-Open 63-45443 discloses a technique for determining an abnormality of an air-fuel ratio controller including a fuel injection valve even when an air-fuel ratio feedback correction coefficient is limited to upper and lower limit values so that a learning value is not renewed, by judging whether or not an air-fuel ratio feedback control is executed when an engine is operated in each learning range for a predetermined time or longer and determining an abnormality of the air-fuel ratio controller when the air-fuel ratio feedback control is not executed in each learning range.

However, in the prior art as described above, only by detecting the abnormality in dependency on presence or absence of execution of the feedback control in a learning range, it is difficult to distinguish a change of the learning value due to an abnormality or deterioration of an intake air measurement system and/or a fuel injection system. And it is also difficult to distinguish the change due to the above mentioned abnormality or deterioration even if the learning value is changed in a predetermined range in a case where a feedback control is executed so that the learning is normally carried out.

SUMMARY OF THE INVENTION

An object of the present invention is to provide a device for detecting an abnormality of an intake air measurement system in an air-fuel control system mounted on an engine where a normal change of a learning value due to a deterioration of the intake air measurement system for measuring a quantity of intake air or a fuel injection system for injecting a fuel into a cylinder is distinguished from a change of the learning value due to the abnormality thereby to precisely and promptly detect the abnormality of the intake air measurement system in the air-fuel control system.

In order to achieve the afore-described object according to a first aspect of the present invention, there is provided a device for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the device which comprises judging means responsive to said engine operating condition signal for deciding whether said various sensors operate normally and for generating a normal signal if each output of said various sensors is in each predetermined normal range; deciding means responsive to said normal signal for judging whether said engine operating condition is satisfied with every condition for diagnosis and for producing a diagnosis signal; determining means responsive to said diagnosis signal for judging whether said engine is controlled in a closed-loop operation and for outputting a closed-loop signal; learning control means responsive to said closed-loop signal for comparing a number of grids being renewed said data in said memory with a predetermined number and for generating a number signal when said number is larger than said predetermined number; calculating means responsive to said a number signal for computing a difference between corrected values in said memory and for producing a difference signal; comparing means responsive to said difference signal for comparing said difference signal with a predetermined difference and for generating an abnormal signal if said difference signal is larger than said both predetermined difference; and warning means responsive to said abnormal signal for indicating an abnormality of said intake air measurement system and for storing said abnormality in a backup RAM in said memory so as to precisely and promptly identify said abnormality from that of deterioration of said sensors.

Another object of the present invention is to provide a device for detecting an abnormality of a fuel injection system in an air-fuel control system mounted on an engine where a normal change of a learning value due to a deterioration of the intake air measurement system for measuring a quantity of intake air or a fuel injection system for injecting a fuel into a cylinder is distinguished from a change of the learning value due to the abnormality thereby to precisely and promptly detect the abnormality of the fuel injection system in the air-fuel control system.

In order to further achieve the above-described object according to a second aspect of the present invention, there is provided a device for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the device which comprises judging means responsive to said engine operating condition signal for deciding whether said various sensors operate normally and for generating a normal signal if each output of said various sensors is in each predetermined normal range; deciding means responsive to said normal signal for judging whether said engine operating condition is satisfied with every condition for diagnosis and for producing a diagnosis signal; determining means responsive to said diagnosis signal for judging whether said engine is controlled in a closed-loop operation and for outputting a closed-loop signal; learning control means responsive to said closed-loop signal for comparing a number of grids being renewed said data in said memory with a predetermined number and for generating a number signal when said number is larger than said predetermined number; calculating means responsive to said a number signal for computing a difference between corrected values in said memory and for producing a difference signal; comparing means responsive to said difference signal for comparing said difference signal with a predetermined difference and for generating an abnormal signal if said difference signal is larger than said both predetermined difference; and warning means responsive to said abnormal signal for indicating an abnormality of said fuel injection system and for storing said abnormality in a backup RAM in said memory so as to precisely and promptly identify said abnormality from that of deterioration of said sensors.

Still another object of the present invention is to provide a method for detecting an abnormality in an air-fuel control system mounted on an engine where a normal change of a learning value due to a deterioration of the intake air measurement system for measuring a quantity of intake air or a fuel injection system for injecting a fuel into a cylinder is distinguished from a change of the learning value due to the abnormality thereby to precisely and promptly detect the abnormality of the intake air measurement system in the air-fuel control system.

In order to achieve the above-described still another object of the present invention according to a third aspect of the present invention, there is provided a method for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the method which comprises the steps of deciding whether said various sensors operate normally and whether each output of said various sensors is in each predetermined normal range; judging whether said engine operating condition is satisfied with every condition for diagnosis signal; determining whether said engine is controlled in a closed-loop operation; comparing a number of grids being renewed said data in said memory with a predetermined number; calculating a difference between corrected values in said memory; comparing said difference if said difference is larger than said both predetermined difference; and warning an abnormality of said intake air measurement system so as to precisely and promptly identify said abnormality from that of deterioration of said sensors.

Still another object of the invention is to provide a method for detecting an abnormality of a fuel injection system in an air-fuel control system mounted on an engine where a normal change of a learning value due to a deterioration of the intake air measurement system for measuring a quantity of intake air or a fuel injection system for injecting a fuel into a cylinder is distinguished from a change of the learning value due to the abnormality thereby to precisely and promptly detect the abnormality of the fuel injection system in the air-fuel control system.

In order to further achieve the above-described still another object of the invention according to a fourth aspect of the present invention, there is provided a method for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the method which comprises the steps of deciding whether said various sensors operate normally and whether each output of said various sensors is in each predetermined normal range; judging whether said engine operating condition is satisfied with every condition for diagnosis diagnosis signal; determining whether said engine is controlled in a closed-loop operation; comparing a number of grids being renewed said data in said memory with a predetermined number; calculating a difference between corrected values in said memory; comparing said difference if said difference is larger than said both predetermined difference; and warning an abnormality of said fuel injection system so as to precisely and promptly identify said abnormality from that of deterioration of said sensors.

According to the device and method for detecting an abnormality in an air-fuel control system mounted on an engine in accordance with the present invention, an abnormality of the intake air measurement system for measuring the quantity of intake air of the engine or the fuel injection system for injecting fuel into a cylinder is determined when a difference between renewed learning values in a memory map within each predetermined range with parameters of an engine load and an engine speed becomes a set value or more. The map is for storing the learning values of air-fuel ratio feedback correction amount based on an output of an air-fuel ratio sensor.

According further to the device and method for detecting the abnormality in an air-fuel control system mounted on the engine, the air-fuel ratio feedback correction amount based on the output of the air-fuel ratio sensor is learned in each predetermined range with parameters of an engine load and an engine speed, the learning value in the memory map is renewed with the learned value, and the abnormality is determined in the intake air measurement system or the fuel injection system is determined when a difference between each learning value in the memory map becomes a set value or more.

These and other objects and features of the present invention will become understood from the following description with reference to the accompanying drawings.

DETAILED DESCRIPTION OF THE PREFERRED EMBODIMENTS

The embodiments of the present invention will be explained with reference to accompanying drawings.

Embodiments of the present invention are shown in FIG. 1 to 5.

Figure 2:
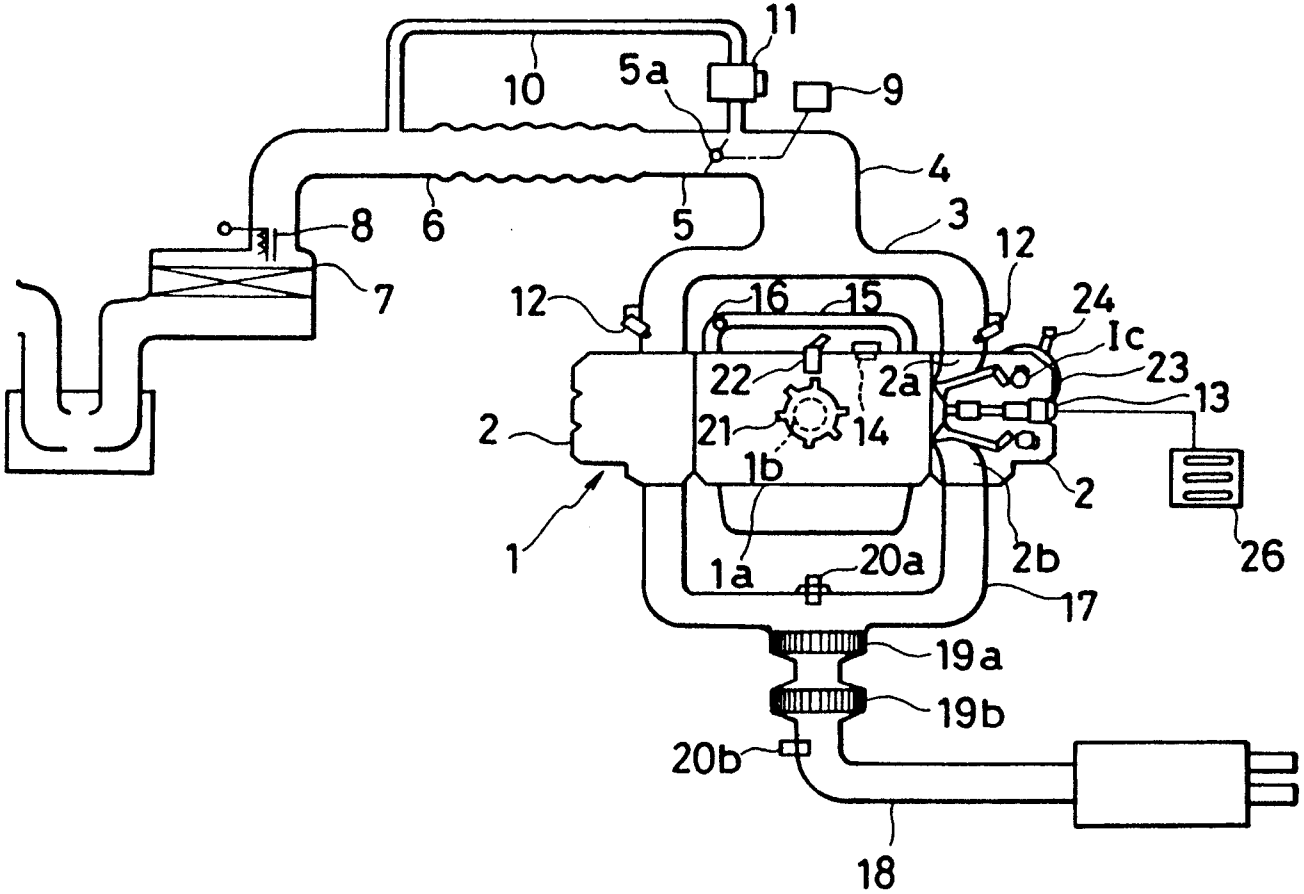
FIG. 2 is a schematic view of an overall arrangement of an engine control system in which the present invention is applied.

In FIG. 2, showing an entire engine control system of executing the present invention, numeral 1 indicates an engine body (a horizontal opposed type engine in FIG. 2). An intake manifold 3 is connected to an intake port 2*a* formed in a cylinder head 2 of the engine body 1. Further, a throttle chamber 5 is connected to an upstream side of the intake manifold 3 through an air chamber 4. And, an air cleaner 7 is mounted at an upstream side of the throttle chamber 5 through an intake pipe 6.

An intake air sensor 8 made of a hot wire or a hot film mounted directly downstream side of the air cleaner 7 of the intake pipe 6, and a throttle sensor 9 is connected to a throttle valve 5*a* provided in the throttle chamber 5.

An idle speed control valve (hereinafter abbreviated as to "an ISCV") 11 is mounted in a bypass passage 10 for communicating an upstream side with a downstream side of the throttle valve 5*a*. An injector 12 is arranged directly upstream side of the intake port 2*a* of each cylinder of the intake manifold 3. A spark plug 13 exposed at its end within a combustion chamber of the engine, is mounted in each cylinder of the cylinder head 2, and an ignitor 26 is connected to the spark plug 13.

A knock sensor 14 is mounted on a cylinder block 1*a* of the engine body 1. A coolant temperature sensor 16 is disposed in a coolant passage 15 formed in the cylinder block 1*a*. Further, an exhaust pipe 18 is connected to an assembly of exhaust manifolds 17 connected to exhaust ports 2*b* of the cylinder head 2.

A front catalytic converter 19*a* is mounted at the assembly of the exhaust manifolds 17. Further, a rear catalytic converter 19*b* is mounted directly downstream of the front catalytic converter 19*a*. A front $O_2$ sensor (hereinafter referred to as "an $FO_2$ sensor") 20*a* is disposed as an air-fuel ratio sensor upstream side of the catalytic converter 19*a*, and a rear $O_2$ sensor (hereinafter referred to as "an $RO_2$ sensor") 20*b* is disposed as an air-fuel ratio sensor downstream side of the converter 19*b*.

The $RO_2$ sensor 20*b* is provided to diagnose a deterioration of a catalyst based on a comparison result of an output of the $FO_2$ sensor 20*a* with that of the $RO_2$ sensor 20*b*.

A crank rotor 21 is journaled at a crank shaft 1*b* supported to the cylinder block 1*a*. A crank angle sensor 22 made of an electromagnetic pickup is opposed to an outer periphery of the crank rotor 21. Further, a cam angle sensor 24 made of the same as above is opposed to a cam rotor 23 connected to a cam shaft 1*c* of the cylinder head 2.

In the engine control system, an engine control unit (hereinafter referred to as "an ECU") 31 to be described in detail later, is provided to calculate an engine speed NE based on a signal from the crank angle sensor 22 when the crank angle sensor 22 detects a protrusion or a slit formed on an outer periphery of the crank rotor 21 at each predetermined crank angle, and to set a fuel injection quantity, an ignition timing, etc. Further, the ECU 31 judges a cylinder operating during a combustion stroke in dependency on a signal from the cam angle sensor 24 when the cam angle sensor 24 detects a protrusion or a slit formed on the outer periphery of the cam rotor 23.

It is noted that the above-described crank angle sensor 22 and the cam angle sensor 24 are not limited to the electromagnetic pickups. For example, the crank angle sensor 22 and the cam angle sensor 24 may be optical sensors.

Figure 3:
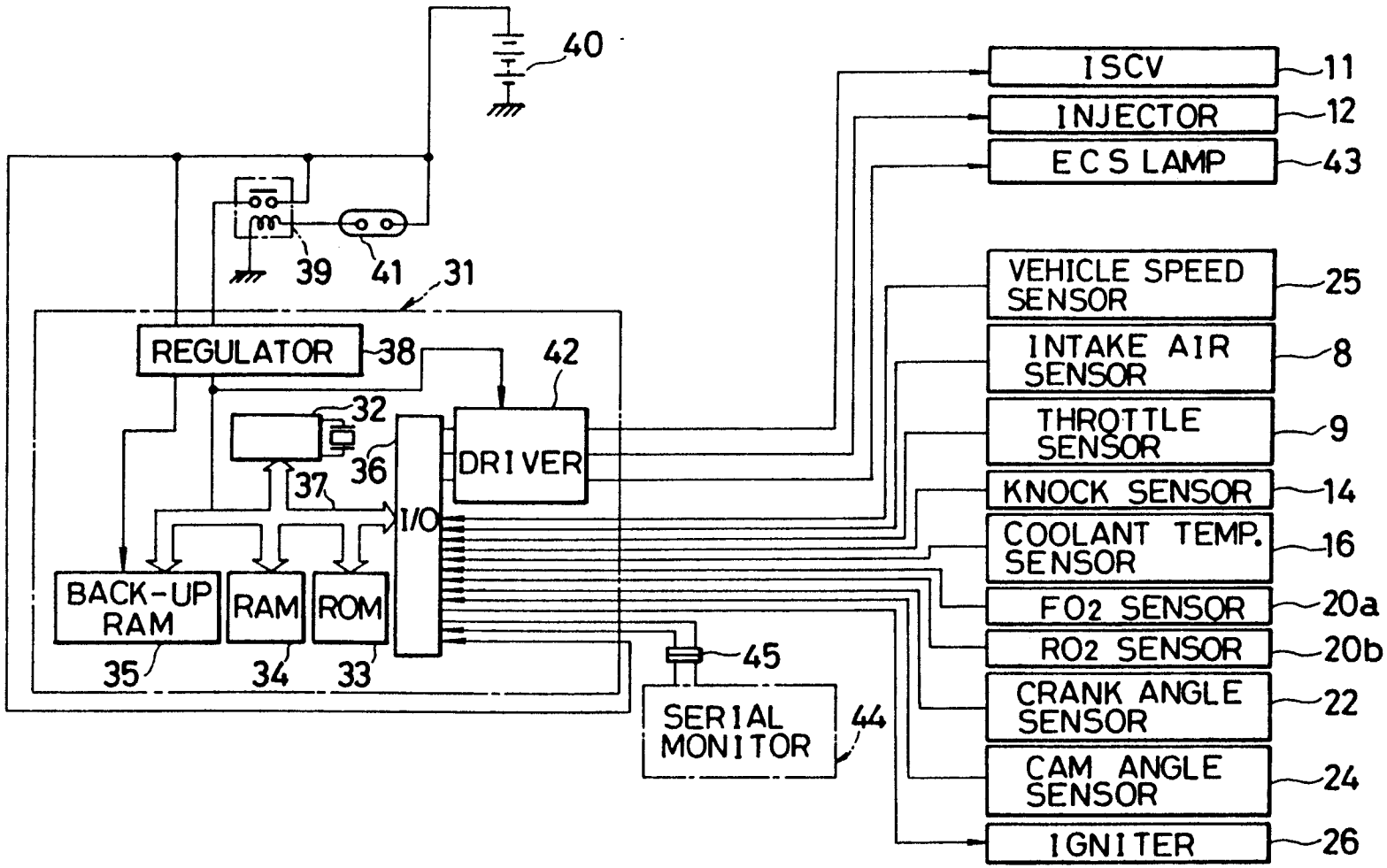
FIG. 3 is a circuit diagram of an arrangement of an electronic control system in which the present invention is applied.

Referring to FIG. 3, showing an arrangement of an electronic control system of the invention, numeral 31 designates an electronic control unit (ECU) made, for example, of a microcomputer or the like. In the ECU 31, a CPU 32, a ROM 33, a RAM 34, a back-up RAM 34, and an I/O interface 36 are connected to each other through a bus line 37, and a constant-voltage regulator 38 supplies a predetermined stabilized voltage to the respective sections.

The regulator 38 is connected directly and through a relay contact of an ECU relay 39 to a battery 40. And, a relay coil of the ECU relay 39 is connected to the battery 40 through an ignition switch 41.

The intake air sensor 8, the throttle sensor 9, the knock sensor 14, the coolant temperature sensor 16, the $FO_2$ sensor 20*a*, the $RO_2$ sensor 20*b* , the crank angle sensor 22, the can angle sensor 24 and a vehicle speed sensor 25 are connected to an input port of the I/O interface 36, and the battery 40 is connected to the input port of the I/O interface 36 to monitor a battery voltage.

On the other hand, the ignitor 26 is connected to an output port of the I/O interface 36. Further, the ISCV 11, the injector 12 and an electronic control system (hereinafter abbreviated to as "an ECS") lamp 43 arranged on an instrument panel (not shown) are connected to the output port of the I/O interface 36 through a driver 42.

A control program and fixed data such as various maps are stored in the ROM 33. Data obtained after output signals of the above-described sensors and switches are processed and data calculated by the CPU 32 are stored in the RAM 34. An air-fuel ratio learning map and data indicating a trouble are stored in the back-up RAM 35, and the data are held even when the ignition switch 41 is turned OFF.

The trouble data can be read out externally by connecting a serial monitor 44 to the ECU 31 through a connector 45. The serial monitor 44 was described in detail in Japanese Patent Application Laid-Open 2-73131 filed by the same assignee as that of the present invention, and hence a detailed description thereof will be omitted.

The CPU 32 calculates an engine speed NE based upon a crank angle signal from the crank angle sensor 22, obtains a basic fuel injection quantity TP based upon the engine speed NE and an intake air quantity QA from the intake air sensor 8, calculates a fuel injection quantity, an ignition timing, etc., and executes an air-fuel ratio feedback control, and an ignition timing control or the like.

In the air-fuel ratio feedback control, an air-fuel ratio feedback correction coefficient $\alpha$ is set as an air-fuel feedback correction amount based on an output of the $FO_2$ sensor 20*a*. The basic fuel injection amount TP is fed back to be corrected according to the air-fuel ratio feedback correction coefficient $\alpha$, and learned to be corrected by referring to the air-fuel ratio learning map. Further, an increasing correction based on various operating condition parameters is applied, and a final fuel injection amount Ti is calculated. A drive signal of the fuel injection amount Ti is output to the injector 12 to allow the injector 12 to inject fuel of the quantity responsive to the drive signal, thereby controlling the air-fuel ratio.

Further, the CPU 32 decides whether or not the intake air measurement system and the fuel injection system are normal in dependency on a learning value updating condition in the air-fuel ratio learning map when a predetermined diagnosis condition is established, lights or flashes the ECS lamp 43 when an abnormality is detected, to generate an alarm, and stores the trouble data in the back-up RAM 35.

Then, the diagnosis of an abnormality of the intake air measurement system and the fuel injection system by the ECU 31 will be described by referring to a flowchart of FIG. 1.

Figure 1:
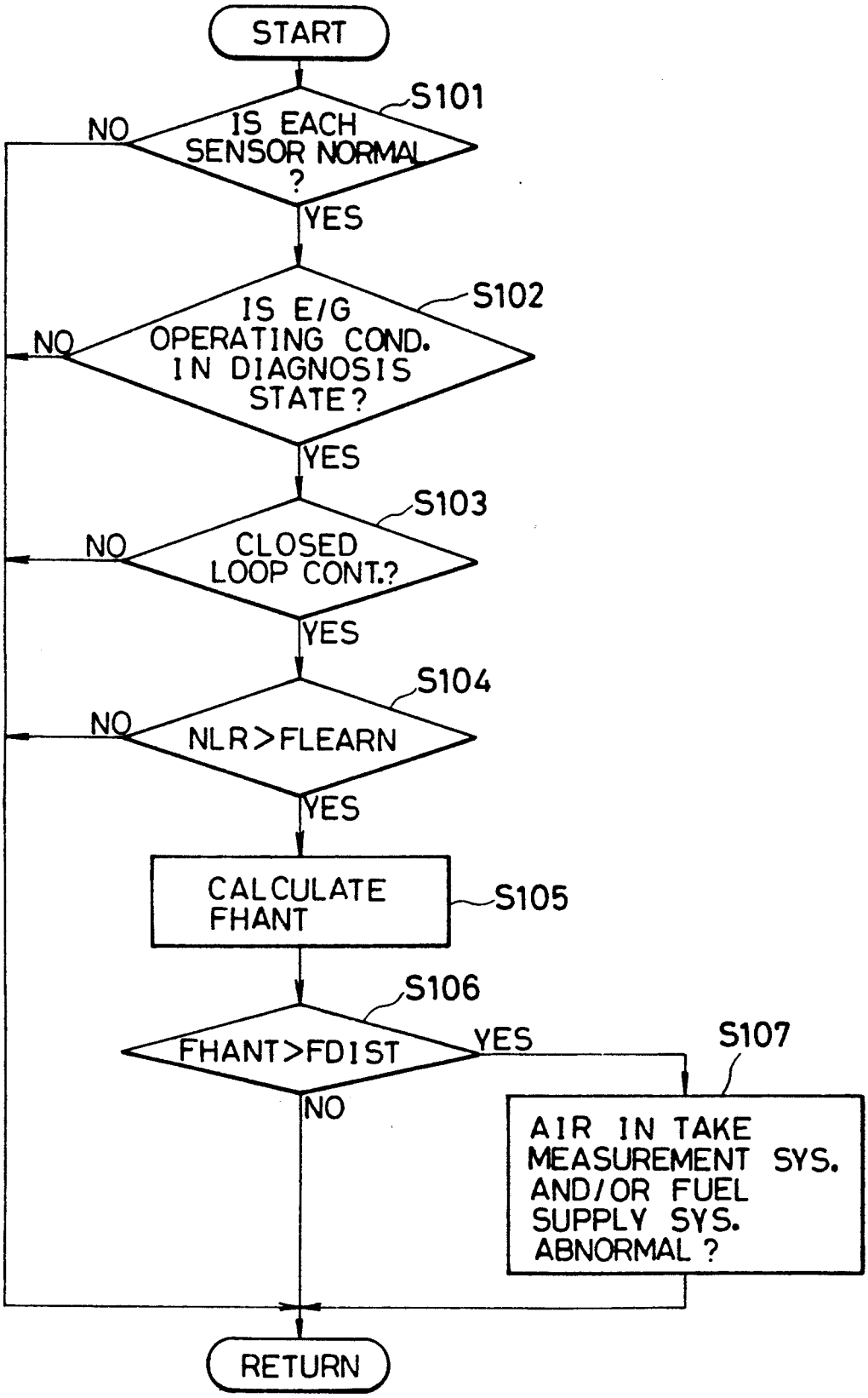
FIG. 1 is a flowchart showing an example of an abnormality detecting routine employed in a device and method for detecting an abnormality in an air-fuel control system of the present invention.

FIG. 1 shows an abnormality detecting routine to be interrupted and executed at each predetermined time according to the present invention. When the abnormality detecting diagnosis routine is started after the engine of the vehicle is operated, first in a step S101, it is diagnosed whether the respective sensors such as, for example, the intake air sensor 8, the throttle sensor 9, the knock sensor 14, the coolant temperature sensor 16, the $FO_2$ sensor 20*a*, the $RO_2$ sensor 20*b* , the crank angle sensor 22, the cam angle sensor 24, the vehicle speed sensor 25 are normal. If any sensor is abnormal, the flow passes the routine to store the trouble data in the back-up RAM 35 and to light or flash the ECS lamp 43, thereby generating an alarm to a driver.

On the other hand, in the step S101, when it is diagnosed that all the sensors are normal, the flow is advanced to a step S102. In the step S102, whether or not the present engine operating condition satisfies a diagnosis condition such as, for example, is a set time or more is elapsed after the engine is started by turning ON the ignition switch 41 ?, or is a coolant temperature TW a set temperature ? If the present engine operating condition does not satisfy the diagnosis condition, the flow passes the routine, while if the present engine condition state satisfies the diagnosis condition, the flow is advanced to a step S103. In the step S103, whether or not the present air-fuel ratio control is operating during a closed-loop control (feedback control) is determined.

For example, when the coolant temperature TW is the set value or less, the engine speed NE is a set speed or more and the basic fuel injection amount TP is a set value or more (in a range that the throttle is fully opened), it is decided that a closed-loop control condition is not satisfied, in the case except this and when the output voltages of the $FO_2$ sensor 20*a* and the $RO_2$ sensor 20*b* are a set value or higher to be activated, it is determined that the closed-loop control condition is satisfied.

In the step S103, when it is decided that the closed-loop control is not executed, the flow passes the routine, i.e., it is determined that the closed-loop control is executed, and then the flow is advanced to a step S104. In the step S104, a number of learning renewed grids NLR in the air-fuel ratio learning map MPLR formed in the back-up RAM 35 is checked, and whether or not the number of the learning renewed grids NLR is larger than a set value FLEARN is determined.

Figure 4:
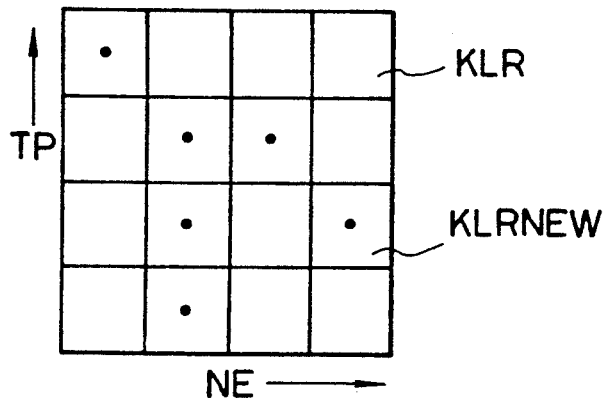
FIG. 4 is a view, for explaining an example of an air-fuel ratio learning map including less number of grids according to the invention.
Figure 5:
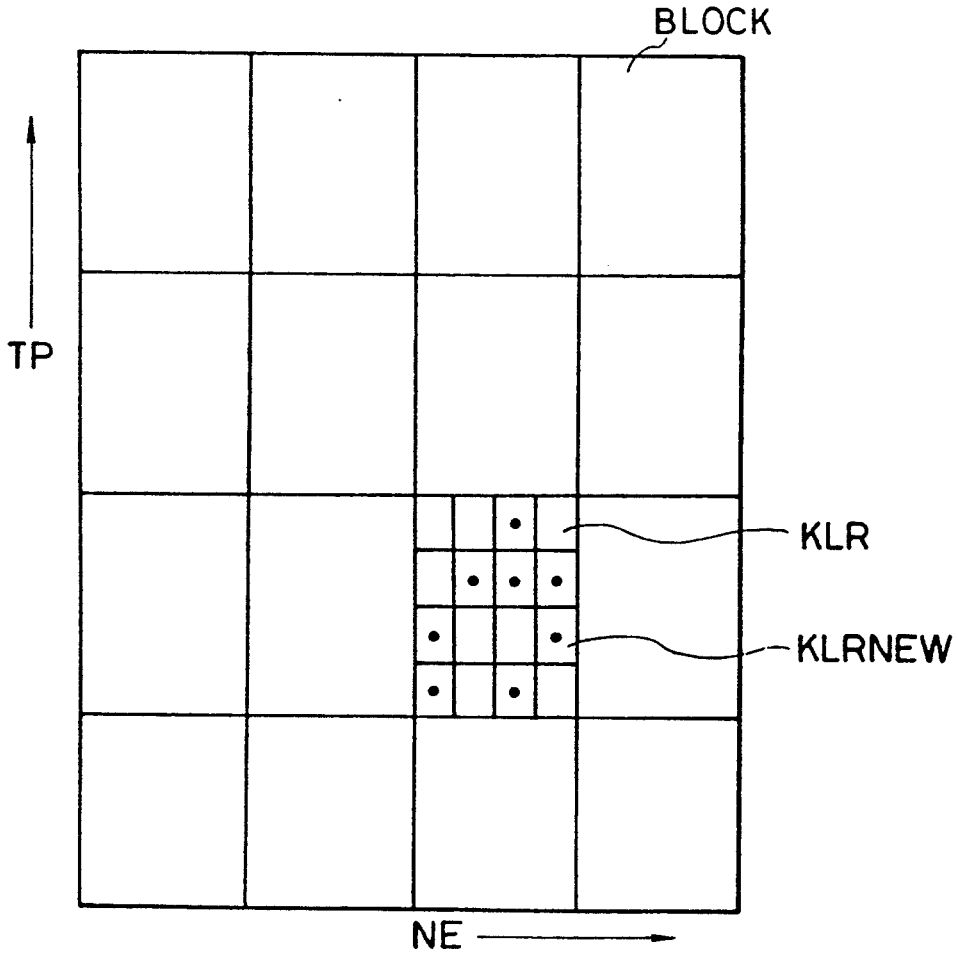
FIG. 5 is a view, for explaining an example of an air-fuel ratio learning map including more number of the grids.

In the air-fuel ration learning map MPLR, as shown in FIG. 4 or 5, a learning value KLP determined based on a difference between an average value of the air-fuel ratio feedback correction coefficients $\alpha$ in a normal operating condition at each grid formed according to the basic fuel injection amount TP as an engine speed NE and an engine load such as, for example, when the air-fuel ratio repeatedly become rich and lean predetermined number of times and a reference value, is stored. When the learning value KLR is renewed, a learning value renewal flag is set, and a number of the learning renewed grids NLR can be checked by referring to the learning value renewal flag.

As a result of the decision in the step S104, if $NLR \leqq FLEARN$ is satisfied and when the number of the learning renewed grids NLR is the set value FLEARN or less, the flow passes the routine, while if $NLR > FLEARN$ is satisfied and when the number of the learned renewed grids is more than the set value FLEARN, the flow is advanced to a step S105. In the step S105, a difference FHANT between the renewed learning values KLRNEW is calculated.

The difference FHANT is suitably calculated in response to the size of the air-fuel ratio learning map MPLR. In case where the air-fuel ratio learning map MPLR is formed, for example, of the number of grids of a relatively small scale such as $4 \times 4$, as shown in FIG. 4, it is given by a number of grids having a predetermined constant difference or more to a standard deviation of the renewed learning value KLRNEW, a difference between a maximum and a minimum of the renewed learning value KLRNEW or an average value of the renewed learning value KLRNEW.

In case where the number of the grids of the air-fuel ratio learning map MPLR is relatively large, the map having a number of grids of 16×16 is divided into blocks of 4×4 as shown in FIG. 5, an average value of the renewed learning value KLRNEW in each block is calculated and used as a representative value of each block. A value FHANT is set as a standard deviation of the representative value of each block. Or, the value FHANT is decided from a difference between the maximum and the minimum of the representative value of each block. Further, the value FHANT is also determined from the number of blocks which has the predetermined difference between an average value of the representative value of each block and a reference value.

The above described calculation is executed after the number of the learning renewed grids in one block becomes proper.

Thereafter, the flow is advanced to a step S106. In the step S106, whether or not the value FHANT calculated in the step S105 is larger than a set value FDIST is judged. If FHANT≦FDIST is satisfied, the flow passes the routine, while if FHANT>FDIST is satisfied, the flow is advanced to a step S107. In the S107, an abnormality is determined in the intake air measurement system or the fuel injection system, corresponding trouble data is stored in the back-up RAM 35, and the ECS lamp 43 is lit or flashed to generate an alarm.

More particularly, when an abnormality is generated in the intake air measurement system such as, for example, dusts are adhered to the intake air sensor 8 so that an output signal of the sensor does not rise in a high engine speed range, it is judged that the quantity of intake air is small in the ECU 31, the quantity of fuel injection is reduced, and the air-fuel ratio becomes lean. When an abnormality is generated in the fuel injection system such as, for example, a valve of the injector 12 is, for example, sticked to reduce a lift of the valve, actual fuel amount to be supplied to the quantity of intake air is reduced. Thus, the air-fuel ratio becomes remarkably lean in a high engine speed range.

In such a case, the air-fuel ratio feedback correction coefficient $\alpha$ based on the output of the $FO_2$ sensor 20*a* is increased from a central value and the renewed learning value KLR becomes remarkably different from other operating range. Accordingly, the abnormality of the intake air measurement system or the fuel injection system can be immediately determined, and the abnormality can be detected distinctly from a change of the learning value due to a normal deterioration thereof.

According to the present invention as described above, an abnormality is determined in the intake air measurement system for measuring the quantity of intake air of the engine or the fuel injection system for injecting a fuel into a cylinder when a difference between the renewed learning values becomes a set value or more in the memory map for storing the learning value of the air-fuel ratio feedback correction amount based on the output of the air-fuel ratio sensor in each predetermined range with parameters of the engine load and the engine speed. Consequently, a normal change of the learning value to a deterioration is distinguished from a change of the learning value due to the abnormality, and the abnormality can be precisely and promptly detected.

While the presently preferred embodiments of the present invention has been shown and described, it is to be understood that these disclosures are for the purpose of illustration and that various changes and modifications may be made without departing from the scope of the invention as set forth in the appended claims.

What is claimed is:

1. A device for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the device which comprises:

judging means responsive to said engine operating condition signal for deciding whether said various sensors operate normally and for generating a normal signal if each output of said various sensors is in each predetermined normal range;

deciding means responsive to said normal signal for judging whether said engine operating condition is satisfied with every condition for diagnosis and for producing a diagnosis signal;

determining means responsive to said diagnosis signal for judging whether said engine is controlled in a closed-loop operation and for outputting a closed-loop signal;

learning control means responsive to said closed-loop signal for comparing a number of grids being renewed said data in said memory with a predetermined number and for generating a number signal when said number is larger than said predetermined number;

calculating means responsive to said a number signal for computing a difference between corrected values in said memory and for producing a difference signal;

comparing means responsive to said difference signal for comparing said difference signal with a predetermined difference and for generating an abnormal signal if said difference signal is larger than said both predetermined difference; and warning means responsive to said abnormal signal for indicating an abnormality of said intake air measurement system and for storing said abnormality in a backup RAM in said memory so as to precisely and promptly identify said abnormality from that of deterioration of said sensors.

2. A device for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the device which comprises:

judging means responsive to said engine operating condition signal for deciding whether said various sensors operate normally and for generating a normal signal if each output of said various sensors is in each predetermined normal range;

deciding means responsive to said normal signal for judging whether said engine operating condition is satisfied with every condition for diagnosis and for producing a diagnosis signal;

determining means responsive to said diagnosis signal for judging whether said engine is controlled in a closed-loop operation and for outputting a closed-loop signal;

learning control means responsive to said closed-loop signal for comparing a number of grids being renewed said data in said memory with a predetermined number and for generating a number signal when said number is larger than said predetermined number;

calculating means responsive to said a number signal for computing a difference between corrected values in said memory and for producing a difference signal;

comparing means responsive to said difference signal for comparing said difference signal with a predetermined difference and for generating an abnormal signal if said difference signal is larger than said both predetermined difference; and warning means responsive to said abnormal signal for indicating an abnormality of said fuel injection system and for storing said abnormality in a backup RAM in said memory so as to precisely and promptly identify said abnormality from that of deterioration of said sensors.

3. A method for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors ±or detecting an engine operating condition and for generating an engine operating condition signal, and control means responsive to said engine operation signal for controlling said engine with data stored in a memory by a learning control, an improvement of the method which comprises the steps of:

deciding whether said various sensors operate normally and whether each output of said various sensors is in each predetermined normal range;

judging whether said engine operating condition is satisfied with every condition for diagnosis diagnosis signal;

determining whether said engine is controlled in a closed-loop operation;

comparing a number of grids being said memory with a predetermined number;

calculating a difference between corrected values in said memory;

comparing said difference if said difference is larger than said both predetermined difference; and warning an abnormality of said intake air measurement system so as to precisely and promptly identify said abnormality from that of deterioration of said sensors.

4. A method for detecting an abnormality in an air-fuel control system mounted on an engine having, an intake air measurement system mounted in an intake pipe for measuring an amount of induced air into said engine, a fuel injection system for injecting a fuel into a cylinder, an air-fuel ratio sensor inserted in an exhaust pipe for detecting an air-fuel ratio near a catalyst, various sensors for detecting an engine operating condition and for generating an engine operating condition signal, and control means responsive to said engine operation signal for controlling said engine with data stored in a memory by a learning control, an improvement of the method which comprises the steps of:

deciding whether said various sensors operate normally and whether each output of said various sensors is in each predetermined normal range;

judging whether said engine operating condition is satisfied with every condition for diagnosis diagnosis signal;

determining whether said engine is controlled in a closed-loop operation;

comparing a number of grids being renewed said data in said memory with a predetermined number;

calculating a difference between corrected values in said memory;

comparing said difference if said difference is larger than said both predetermined difference; and warning an abnormality of said fuel injection system so as to precisely and promptly identify said abnormality from that of deterioration of said sensors.

* * * * *